US007719435B2

(12) United States Patent
Readler et al.

(10) Patent No.: US 7,719,435 B2
(45) Date of Patent: May 18, 2010

(54) SECURITY TELEVISION SIMULATOR WITH REALISTIC EMULATION OF TELEVISION OUTPUT

(76) Inventors: Blaine C. Readler, 11320 Florindo Rd., San Diego, CA (US) 92127; Rein S. Teder, 9401 Xylon Ave., Bloomington, MN (US) 55438

( * ) Notice: Subject to any disclaimer, the term of this patent is extended or adjusted under 35 U.S.C. 154(b) by 287 days.

(21) Appl. No.: 11/998,193

(22) Filed: Nov. 30, 2007

(65) Prior Publication Data

US 2008/0186149 A1 Aug. 7, 2008

Related U.S. Application Data

(63) Continuation-in-part of application No. 11/701,659, filed on Feb. 5, 2007.

(51) Int. Cl.

| | |
|---|---|
| ***G08B 1/00*** | (2006.01) |
| ***G08B 13/00*** | (2006.01) |
| ***G08B 5/00*** | (2006.01) |
| ***G09F 9/33*** | (2006.01) |
| ***G09G 3/06*** | (2006.01) |
| ***G09G 3/12*** | (2006.01) |
| ***G09G 3/14*** | (2006.01) |

(52) U.S. Cl. ..... 340/691.6; 340/309.16; 340/309.2; 340/309.3; 340/309.4; 340/541; 340/815.45; 340/691.2; 345/44; 345/45; 345/46

(58) Field of Classification Search ..... 340/309.16, 340/541, 815.45, 691.2, 309.2–309.4; 345/44–46
See application file for complete search history.

(56) References Cited

U.S. PATENT DOCUMENTS

| | | | | |
|---|---|---|---|---|
| 4,970,489 | A * | 11/1990 | Jenkins et al. | 340/309.8 |
| 5,032,766 | A | 7/1991 | Gundlach | |
| 5,442,524 | A * | 8/1995 | Farmer | 362/35 |
| 7,365,649 | B2 | 4/2008 | Weitzel | |

FOREIGN PATENT DOCUMENTS

| | | | |
|---|---|---|---|
| DE | 4343708 | A1 | 12/1993 |
| GB | 2318461 | A | 4/1998 |
| GB | 2398862 | A | 9/2004 |
| GB | 2443898 | A | 5/2008 |

* cited by examiner

*Primary Examiner*—Benjamin C Lee
*Assistant Examiner*—Lam P Pham

(57) ABSTRACT

Method and apparatus for simulating an operating television for the purpose of deterring potential intruders by providing the appearance that one or more occupants are at home. Realistic simulation of a television is accomplished via perceived random combinations, amplitudes, colors, and durations of television program scene modes, these scene modes comprised of fades, swells, flicks, static periods, and low frequency noise. Color shifts, both subtle and dramatic, effectively emulate true television output. Efficient, reliable, and inexpensive super-bright LEDs serve as light sources.

9 Claims, 9 Drawing Sheets

SECURITY TELEVISION SIMULATOR WITH REALISTIC EMULATION OF TELEVISION OUTPUT

CROSS-REFERENCE TO RELATED APPLICATIONS

This application is related to Readler U.S. patent application Ser. No. 11/701,659 entitled "SECURITY TELEVISION SIMULATOR", filed on Feb. 5, 2007, which is hereby incorporated by reference.

SEQUENCE LISTING

Not Applicable

BACKGROUND

1. Field of Invention

This invention relates to security devices, and specifically to security devices that mislead potential intruders into thinking that there are occupants at home.

2. Description of Prior Art

Home security is an ongoing concern for nearly everybody. As long as there are people who have homes containing possessions, there are others who would, provided the opportunity, break into those homes to steal those possessions. Alarm systems are available that attempt the detection of intruders and, in response, alert the homeowner, a hired security company, or neighbors. However, as long as the intruder believes he has time where he won't be disturbed, he is often able to disable or circumvent the alarm system. In any case, damage can occur before an alarm is sounded.

A better defense against intruders is to deter them from considering entry in the first place. It has been shown that a dog inside the house can be effective in this regard. Not everybody can, nor wants, to own a dog, though. Also, it is often not feasible to leave a dog alone during extended trips. And, finally, an unrestrained, un-reprimanded dog barking inside can often have the opposite effect—reassuring the desirous intruder that no one is indeed at home.

A proven means for deterring potential intruders is to convince them that someone is at home. It is common for homeowners to place timers on lights to give the illusion of occupancy. This is helpful, but too static. U.S. Pat. No. 4,970,489 describes an occupancy simulator that casts shadows on an interior wall which are meant to resemble people walking to and fro within. This patent suffers the failing that the intended simulation of human presence falls woefully short of actual realism. The device described casts shadows that move steadily across the wall with no apparent animation, as though a statue were being dragged back and forth. Additionally, an observer intuitively understands that distinct shadows are cast on a wall by a single, undiffused light source, and that this type of lighting is extremely rare in a modern home, where room lighting is generally provided by recessed ceiling lights, or by lamps or ceiling lights that include shades which specifically diffuse the light in order to eliminate distinct shadows.

U.S. Pat. No. 5,442,524 describes a different approach to the same ends by casting moving shadows across the inside of a shade or curtain. Although the invention attempts to incorporate a certain degree of randomness to the speed of the parade of shadows, the fact that they always move in one direction, and that their shapes remain fixed and inanimate, leave the result to also fall far short of a convincing simulation of human movements. Additionally, although the rate of rotation of the generating mechanism is not constant, the shadow patterns still repeat every few minutes, thus betraying the artificial source.

Although it is common to leave lights and even a radio on inside, there are few better indications of occupancy than the distinctive flickering, subtly changing light from an operating television. Some people do indeed leave a visible television on while out for an evening, but this is rarely considered practical for extended absences. Additionally, the televisions may be located in inner rooms where they would not have visible indications from outside.

U.S. Pat. No. 5,252,947 to Marciano describes a home security device for simulating a television. This method, however, lacks substantial ability to convincingly mimic a modern television for multiple reasons. Firstly, the invention teaches a flasher for varying the brightness of a light source. These known flasher devices enable electricity to flow in an interrupted, semi-regular fashion that, when used with the light source, produce a slow-rhythm strobing effect. Further, the invention describes a twin filament, blue tinted bulb, allowing the output of the invention to assume two different levels of brightness. A plausible resulting output of the security device is presented herein in FIG. 1. The radiated intensity assumes a lower level 2 when only a first, less bright filament is energized, and a second level 4 when a more powerful filament is energized. Typical incandescent bulbs have a response time shown as $T_R$, allowing a short transition time between levels. Marciano asserts that this resulting combination produces a "random and varying brightness", but known flasher technology can assume only a modest variation of time values. Presumably, the periods of time where the output intensity is low ($T_L$) and high ($T_H$) can be made to vary somewhat, although a method for doing so is not taught. Similarly, the light output of the taught twin-filament bulb can be expected to assume only two discrete values. This is in contrast to the continuous variation of intensity produced by a real television. Additionally, the nature of the light output of the security device is that it shifts alternately from high to low and back again. This would appear quite mechanistic and predictable to an observer. A real television might, over a particular interval of time, shift from low to medium, to high, and then to higher still.

These shortcomings notwithstanding, however, the device of U.S. Pat. No. 5,252,947 thus simulates the light output of a television to a first approximation. The invention may plausibly yield a first impression to a potential burglar of a functional television. The actual light output of a real television, however, is far more subtle and dynamic than could be produced by the teachings. Even if the flasher device was somehow made to switch on and off in a more truly random manner, this still would not fairly simulate an actual television in operation. A typical television image consists of complex patterns, as scenes fade, swell, abruptly change, or slowly transition as the camera pans, resulting in images that thusly fade, swell, flick, and remain nearly steady for varying periods of time. The light output cast upon a window by a real television is highly characteristic; it is not truly random. While a burglar may be momentarily fooled by the invention, further observation would likely cause him to realize that the source of the illumination is something other than a real television. The burglar does not need to understand the details of why the simulation is inaccurate; humans are remarkably good at recognizing even subtle patterns. A poor simulation or obvious ruse can have the undesirable effect of confirming to the would-be burglar that the house is, in fact, unoccupied. Further, the invention teaches a blue light, which is appropriate for a black-and-white television, whereas virtually all modern televisions for home use are color. The light source of the invention is "multi-color", meaning that the filament is white, but the glass bulb itself is blue. There is no teaching or suggestion that the overall color of the illumination produced by the invention vary in hue to simulate the output of a color television. The color shifts of the light cast by a color television are often subtle, but human beings (including would-be burglars) are remarkably adept at discerning even slight variations in color.

Additionally, the response time of a typical incandescent light is fixed by the thermal time constant of the filament, and is on the order of a tenth of a second. In a real television, some intensity level shifts are often much shorter, being virtually instantaneous. Other level shifts are much longer, being on the order of several seconds. The fixed time constant of U.S. Pat. No. 5,252,947 does not mimic the widely varying rise and fall times of the output of a true television. Further, the invention does not actually teach or suggest a true method of producing a truly random and dynamically varying brightness. What is needed is a more accurate simulation of the light output of a modern color television.

Finally, U.S. Pat. No. 5,252,947 describes an incandescent bulb which is wasteful of energy and could burn out when operated over extended periods of absence.

As is demonstrated in the failings of all of the just-described patents, humans and their activities exhibit both a subtly and a sophistication that is not readily imitated by regular, repetitive actions, whether a flashing light intended to imitate an operating television, or carousel-type shadows moving back and forth across a wall or window covering.

Advantageous would be a device that accurately simulates an operating television that could be easily positioned anywhere in the home.

SUMMARY OF THE INVENTION

Therefore, in accordance with the present invention, a method for accurately simulating a television image uses intensity fades, swells, flicks, static periods, and varying realistic colors through a long-lasting and energy-efficient LED light source. Since the LED light source is extremely low-powered, the simulating device can be housed in a small, portable enclosure, and can operate either from household electricity, or from batteries.

Objects and Advantages

Accordingly, several objects and advantages of the present invention are:

a) to provide a method for simulating a television image that is realistic, b) to provide such a television simulator that is inexpensive, c) to provide a television simulator that is reliable, d) to provide a television simulator that is energy-efficient, e) to provide a television simulator that is easy to use, f) to provide a television simulator that can operate either from household electricity, or from batteries.

DETAILED DESCRIPTION OF THE INVENTION

When viewed directly, a television screen depicts the camera's view of an image, but viewed indirectly, as, for example, when illuminating a window shade, the details of the image meld together so as to form a virtual single light source, whose color and intensity comprises the average of all the collective pixels of the television screen. Using a light source of varying color and intensity, the invention simulates an operating television as it would appear shining on a translucent surface, such as window shades or curtains, or reflected off obliquely positioned surfaces, such as window blinds or an inside wall.

It is well understood in optical design that all the perceived colors of the spectrum can be created by combining, in different proportional intensities, three primary light sources: red, green, and blue. By varying the individual intensities of three light sources of these primary colors, the invention creates a great variety of colors, simulating the complex mix of colors that meld in the ever-changing television programs. The preferred embodiment described here uses, as the primary color light sources, efficient super-bright LEDs. Some advantages of these over traditional light sources, such as incandescent bulbs, are that they are highly efficient—using 1/50th as much power as incandescent bulbs for the same lumens of beamed light—and, long lasting—at least 50 times the life of an average 60 Watt light bulb.

Although there appears, in the melded, combined light of a television program, an element of randomness, the actual effect is far more subtle than simple random changes in intensity and color. Television programs consist of a mix of continuous, sometimes rapid-fire, scene changes, and longer static scenes accompanied by occasional camera fades and swells.

Approximations of Melded Television Images, FIGS. 2-5

Figure 1:
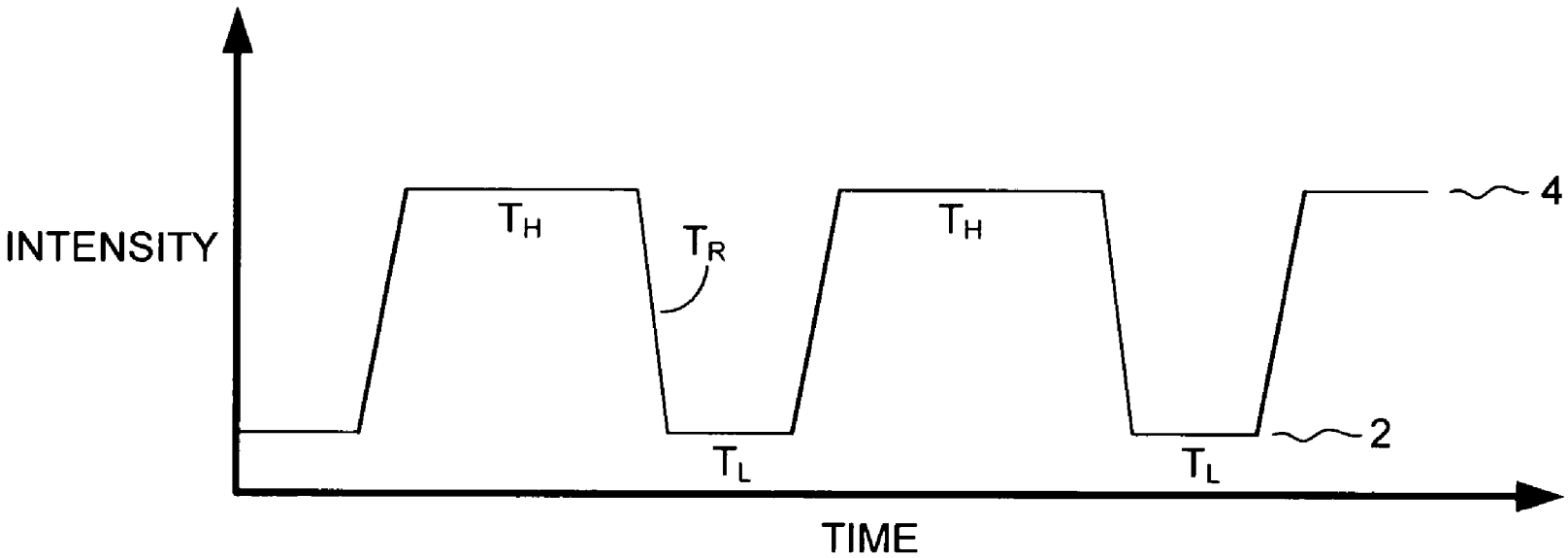
FIG. 1 shows a plausible output of the prior-art security device taught in U.S. Pat. No. 5,252,947.
Figure 2:
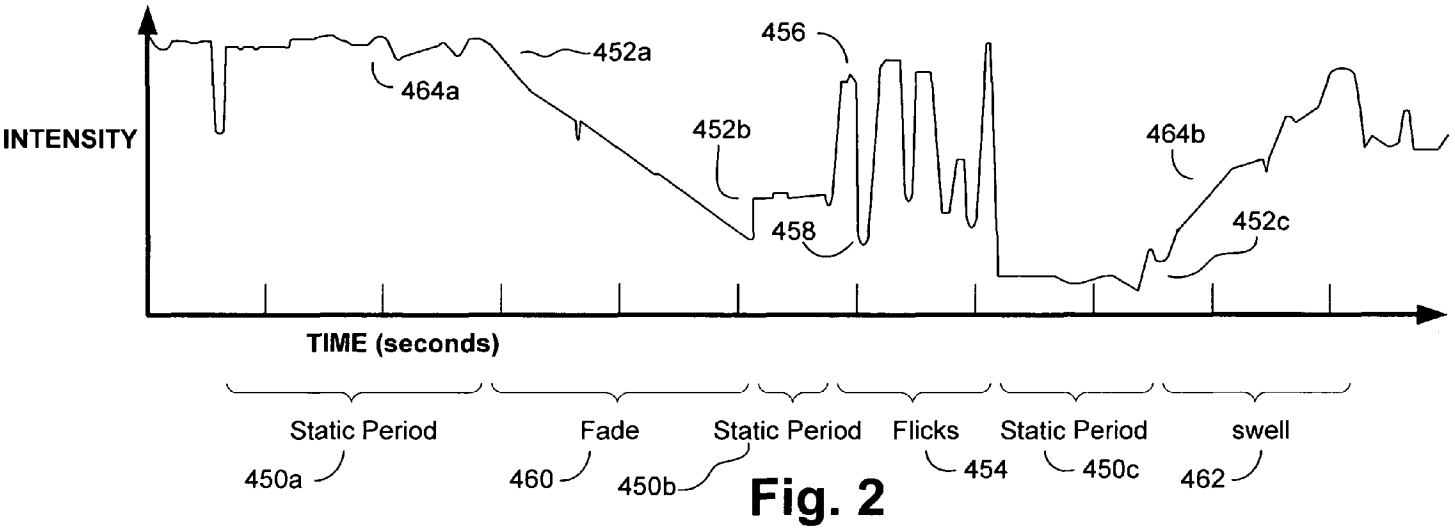
FIG. 2 shows the melded light intensity of a typical television program.

FIG. 2 shows the characteristic forms of the melded light intensity of a typical television program as captured by a broad-spectrum photosensitive detector. Although a continuously variable waveform results as the video camera moves, and actors and scene lighting shift, three distinct forms are identified:

1) static scenes 450*a*, 450*b*, and 450*c*, where the video camera remains stationary on a nearly constant image. Such scenes are characterized by nearly constant intensity levels 452*a*, 452*b*, and 452*c*. Each of such levels 452*a*, 452*b*, and 452*c* may assume any intensity level between dark and full brightness. The first static period, 452*a*, is at a high brightness, the second, 452*b*, at medium low, and the third, 452*c*, at very low. The intensity levels of static periods vary over a range of at least 3:1, and typically more. Static scenes 450*a*, 450*b*, and 450*c* demonstrate durations from roughly half a second to roughly two and a half seconds. Over time, the preferred embodiment produces occasional static scenes that are as long as eight seconds. Thus, durations of static scenes vary over a range of at least 3:1, and typically more. Static scene durations longer than eight seconds are rare in typical television programming, and are thus not implemented in the preferred embodiment, 2) flicks 454, where rapidly changing camera positions or scene movement as might be encountered through a moving train window produce short, nearly instantaneous fluctuations in intensity. The time scale of flicks is less than a second. Flicks can be either positive, as shown at 456, or negative, as show at 458, 3) fades 460 and swells 462, where the edited video image is made to slowly ramp, i.e. decrease or increase in intensity, for artistic affect, or scene lighting happens to change slowly, producing a similar melded effect. Fades and swells are typically on the order of from a half a second on up through several seconds.

4) A low frequency intensity noise component, linearly superimposed upon the aforementioned elements. This noise component may or may not be present in any one scene, and may be of different amplitudes or frequency contents. In FIG. 2, the extended static period 450*a* has a considerable noise component 464*a* present, as does the swell of increasing intensity at 462 contain noise component 464*b*.

Practical generation of these forms suggests that portions of the waveforms be represented in an approximate fashion, specifically, that minor fluctuations, too fine for human perception to notice, be smoothed so that relatively short durations of flat variation result. To the human eye, the idealized forms are nearly indiscernible from the original waveform.

Figure 3:
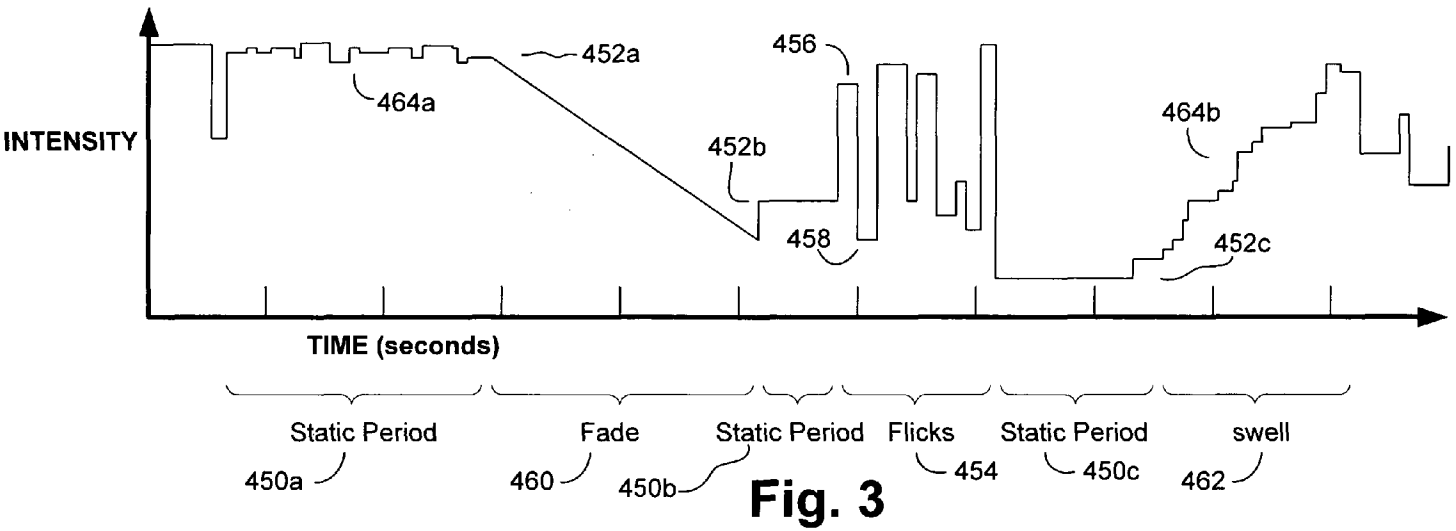
FIG. 3 shows the same captured television melded image as it might appear in an approximate form.

FIG. 3 shows the same characteristic forms of the captured television melded image as they might appear in an approximate form just described. Visible here is that within each categorized form of static, flick, or ramps, are apparent elements of randomness. For example, the amplitudes and durations of static periods, the amplitudes, and durations of individual flick components, as well as the overall flick period, and the rate of fade or swell of ramps. Although the approximate form contains the appearance of elements of randomness, key to a realistic simulation of an operating television is that the apparent randomness is encapsulated within the structure of the forms of television program effects as described. Each of these forms may be thought of as the modes or scenes that comprise the melded image.

The most important single aspect of the television simulation is that the signal be uncorrelated with its history; it cannot appear to be forming any sort of pattern, or it would appear to be mechanistic, and give the impression of emanating from some unknown source other than television. Of the simulation elements previously described, static shifts are the most prominent, as they are the most prevalent in the signal.

The foregoing discussion dealt with broad-spectrum—i.e., all-color—amplitudes, however, similar reasoning and approaches apply to color variations. So, for example, while the overall amplitude of the melded image may fade as the television program depicts an artistic time-condensed view of a sunset, the color would correspondingly change from nearly white to deep red.

Figure 4:
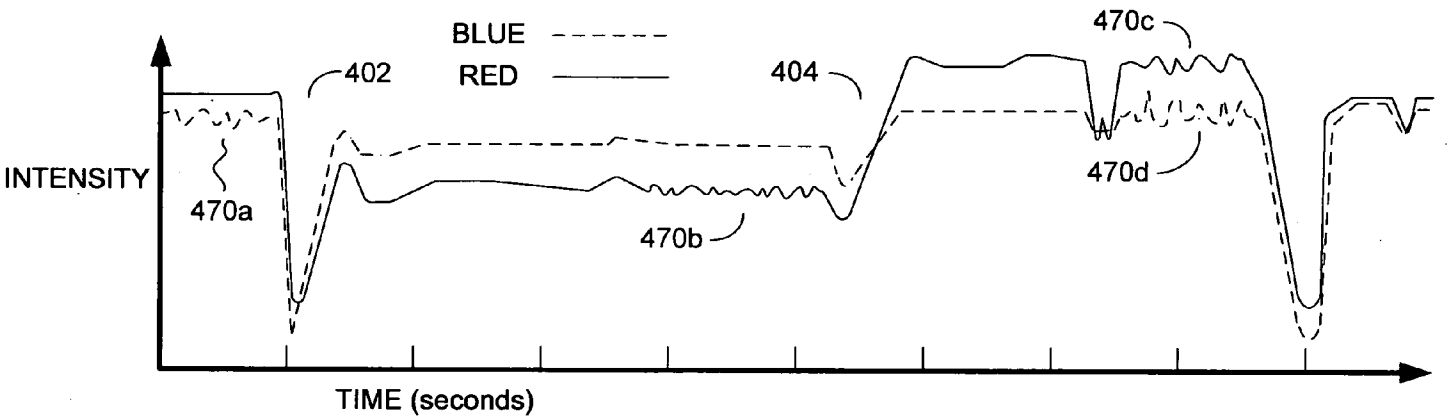
FIG. 4 shows the red and blue color component intensity of a typical television program.

FIG. 4 shows the red and blue color component intensities of a typical television program as captured by two color-filtered photosensitive detectors logging data simultaneously. Here, the changes in the hue of the melded image can be seen to change with scene transitions. For the first second of the captured segment, the hue is predominantly red. Then, at about one second, scene transition 402 results in the hue changing to predominantly blue for about four and a half seconds. The overall intensity of the television light is reduced only slightly, but the perceived color shift is quite pronounced to the observer. After the blue scene, a second scene transition 404 produces an even stronger red hue than at the beginning. FIG. 4 additionally shows that low frequency noise may, for periods of times, be present in only the blue signal 470*a*, only the red 470*b*, or in both signals 470*c* and 470*d*.

Figure 5:
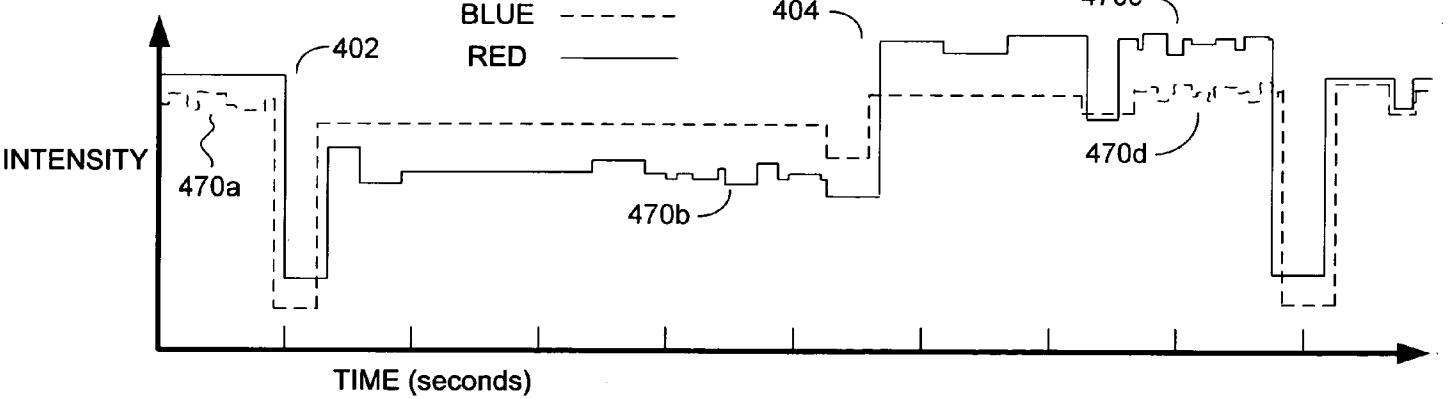
FIG. 5 shows the same captured television red and blue color component intensity as it might appear in an approximate form.

FIG. 5 shows an approximate form for the captured waveforms of FIG. 4. To the human eye, the combined light of the two colors would appear virtually identical between FIGS. 4 and 5. Note that the presence of low frequency noise periods 470*a*, 470*b*, 470*c*, and 470*d*, are also accurately emulated.

Analysis of longer periods of captured data reveals that, statistically, television output tends to favor brighter scenes. Thus, a realistic television simulation should tend to be statistically weighted to deliver more scenes of higher intensity than of lower. Additionally, color shifts should be limited in dynamic range. This is accomplished in the present invention by an appropriate selection of colored LEDs.

Digital logic, whether discrete or implemented in software programs, lends itself to the generation of the waveforms as shown in FIGS. 3 and 5, where counters loaded with random or pseudo-random values, track form types, amplitudes, durations, and ramp slopes. Accordingly, in order to accurately simulate an operating television's melded image, the preferred embodiment of the invention uses digital logic to pseudo-randomly generate color-coordinated scene changes, including varying duration and amplitude static periods, flicks, scene fades and swells, and low-frequency noise.

Figure 6:
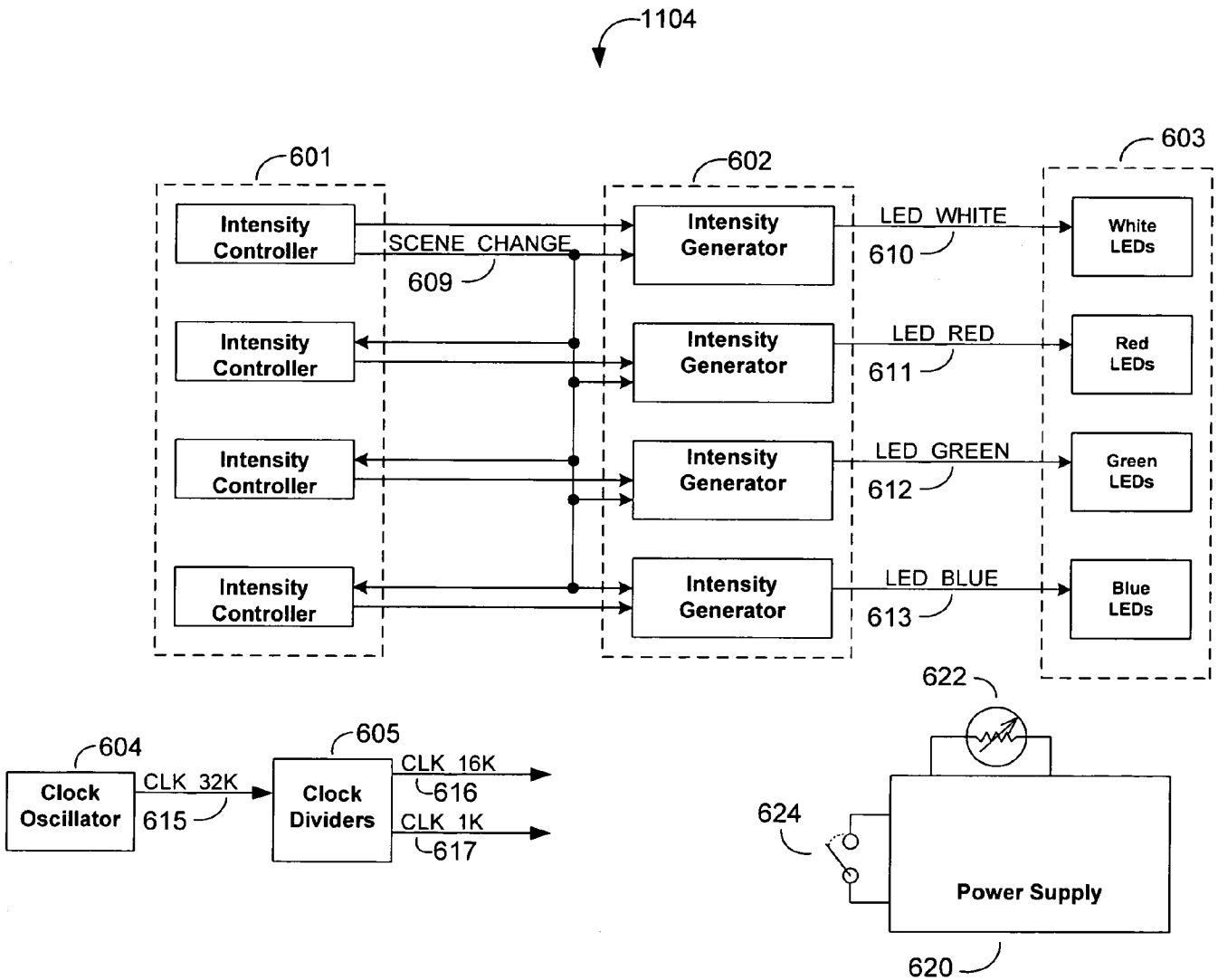
FIG. 6 is a block diagram of a television simulator according to the present invention.

Television Simulator Block Operation, FIG. 6

FIG. 6 shows a block view of the operation of the invention. Blocks 603 show the super-bright LED light sources. Although, as has already been explained, a large variety of perceived colors can be created using the three primary red, green, and blue colors, a large proportion of light in our everyday world, and, consequently, the images displayed on television programs, are white, or varying degrees of gray-scale. Therefore, a more efficient and effective effect is achieved by supplementing the color generation with a direct white component. Note that different embodiments may contain any number of LEDs operating in parallel, as will be explained later.

Blocks 601 comprise the Intensity Controllers, one for each color. This function creates characteristically changing intensity levels as communicated by a binary digital number. The Intensity Controller block 601 associated with the white LED serves as the master, and coordinates simultaneous scene changes across all colors via signal SCENE_CHANGE 609.

Whereas block 601 creates the binary digital information associated with intensity levels, block 602 translates this intensity information into average electrical currents which, when converted to light via super-bright LEDs 603, produce the perceived melded television image.

Clock oscillator 604 is a common, readily available 32.768 KHz oscillator which generates free-running digital clock signal CLK_32K 615, which in turn is divided down by Clock Dividers 605 to create the basic digital clocks CLK_16K 616 and CLK_1K 617, which drive the remaining digital circuitry. Clock signal CLK_16K is created via a modulo 2 counter which is clocked by signal CLK_32K, and has a periodic frequency of approximately 16 KHz. Clock signal CLK_1K is created via a modulo 16 counter which is clocked by signal CLK_16K, and has a periodic frequency of approximately 1 KHz.

Additionally, the present television simulator includes a power supply 620, with a light sensing element 622 generally disposed to measure ambient light intensity in the room in which the simulator is deployed. The light sensor is configured to turn on the simulator at dusk upon detecting a low light level. A timer within the power supply continues operation of the invention for nominally seven hours, whereupon the light output ceases. Detection of a higher predetermined level of ambient light, as occurs at dawn, resets the timer, so that it is ready to operate upon the next detection of dusk. Optionally switch 624 allows the unit to operate continuously, without the timer.

Collectively, these functions comprise the television circuit simulator, and in the preferred embodiment are housed and interconnected on circuit board 1104 shown in FIG. 13, which is described in more detail later.

Figure 7:
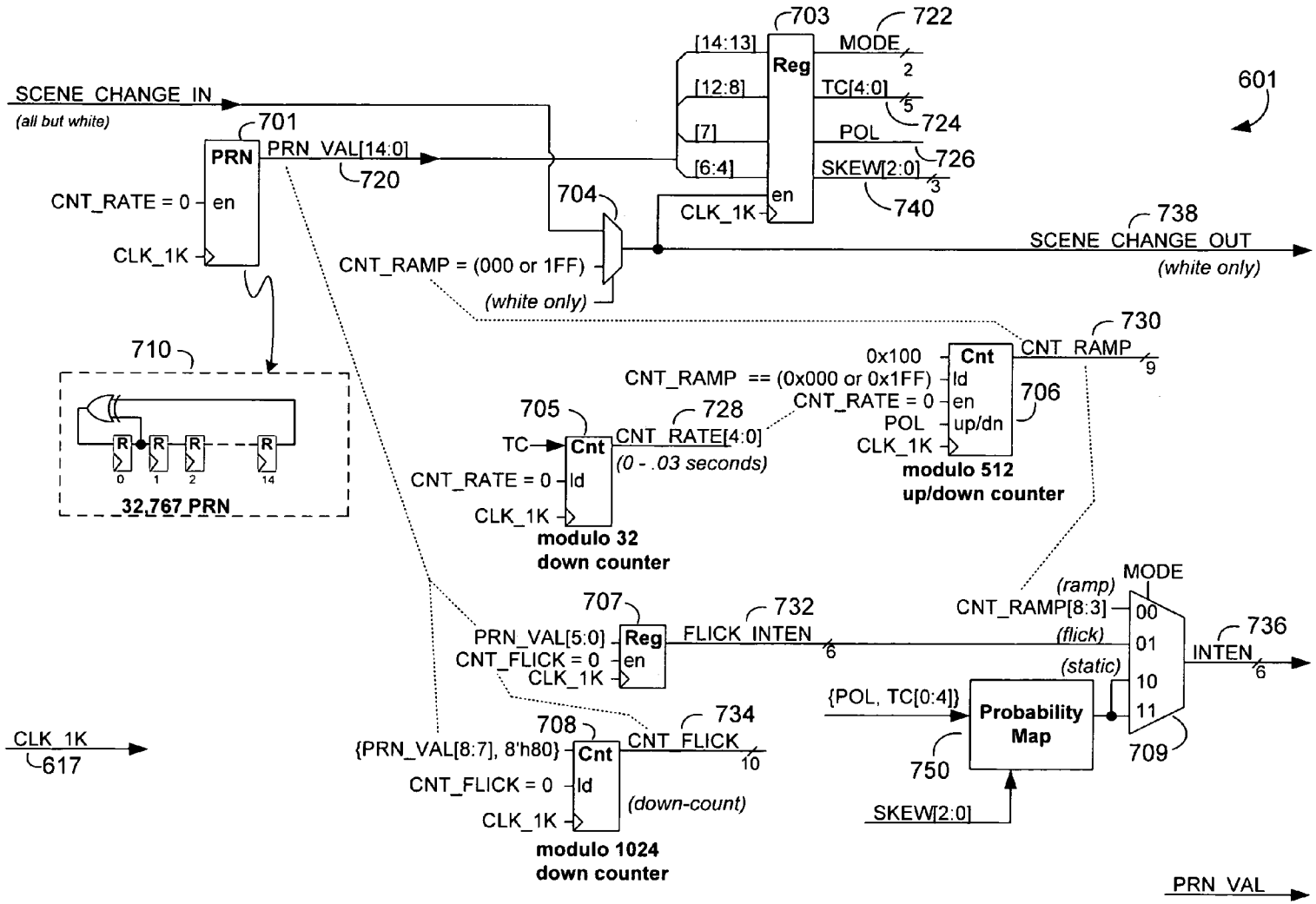
FIG. 7 shows a functional diagram of the Intensity Controller block of FIG. 6.
Figure 9:
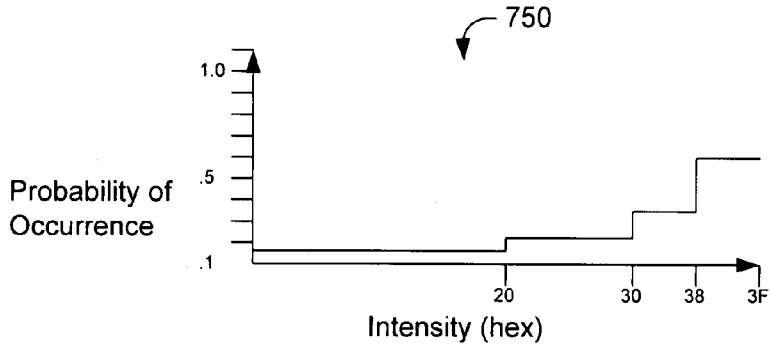
FIG. 9 illustrates a probability mapping of the Probability Map block of FIG. 7.

Intensity Controller, FIGS. 7 & 9

FIG. 7 shows a block view of the operation of the Intensity Controller 601 already introduced in FIG. 6. As will be seen, Intensity Controller 601 serves to generate a six-bit binary INTEN value 736 whose magnitude, when converted to a corresponding light source intensity, mimics the melded light of a television. The overall operation of Intensity Controller 601 is controlled by four binary values stored in holding register 703: MODE signal 722, which determines the current basic type of operation, TC signal 724, which determines how long the current type of operation will last, POL signal 726, which, when selected for a ramp type of operation (as established by MODE), determines whether the ramp is swelling, i.e., increasing in brightness, or fading, i.e., decreasing in brightness, and SKEW signal 740, which biases the LED intensity towards higher levels.

As was seen in FIG. 6, Intensity Controller 601 operates in two configured versions, depending on whether it is associated with the white LED, or the other colors. Each version will now be described separately.

White LED Version:

Pseudo-random generator 701 provides an element of apparent randomness to some aspects of the operation, although the INTEN output is not itself varying in a random, or pseudo-random fashion. Dashed box 710 shows the operation of the Linear Feedback Shift Register (LSFR) 32,767-value pseudo-random generator, which is not described further since this form is well known in the art.

Pseudo-random generator 701 operates in concert with holding register 703, modulo 32 rate count down-counter 705, and modulo 512 ramp count up/down-counter 706 to update holding register 703 in a non-regular fashion with control parameters that vary with each update.

In order to understand this coordinated operation, first assume that holding register 703 has just been updated with new MODE, TC, and POL values. Note that rate count down-counter 705 operates in a cyclical manner, continually decrementing until it reaches zero, at which point value TC is loaded, whereby it begins decrementing again from there. Therefore, a new TC value establishes a new cyclical period for rate count down-counter 705. In turn, each instance that rate count down-counter 705 completes a cycle, as defined by its output CNT_RATE 728 reaching zero, both pseudo-random generator 701 and ramp count up/down-counter 706 are enabled for one clock. Whereas pseudo-random generator 701 steps forward to its next pseudo-random value, ramp count up/down-counter 706 either increments or decrements by one, as directed by holding value POL. Rate count down-counter 705 continues cycling, incrementing or decrementing ramp count up/down-counter 706 with each pass, until ramp count up/down-counter 706 reaches its minimum value (hex 0x000), or maximum value (hex 0x1FF). At this point, ramp count up/down-counter 706 is loaded with its midpoint value (hex 0x100) and holding register 703 is loaded with new values from pseudo-random generator 701, and the process begins again. In this way, it is seen that holding register 703 is loaded with new MODE, TC, POL, SKEW values at varying periods of time, and that the output of ramp count up/down-counter 706, CNT_RAMP 730, comprises a ramping value, either up or down, whose length also varies with each cycle.

Attention is now turned back to Intensity Controller output INTEN 736. Multiplexer 709 determines from which source INTEN is produced, as selected by MODE. When MODE is binary value 00, INTEN comprises the most significant bits of CNT_RAMP, and, therefore, in this mode, INTEN is a continually decreasing or increasing ramp value. This corresponds to the camera fade and swell functions previously described. When MODE is either binary value 10 or 11, INTEN is derived, via Probability Map function 750 described below, from a value that is a combination of signals POL 726 and TC 724 from holding register 703, and, therefore, INTEN is constant for the duration of this mode. This corresponds to the static function previously described. Note that the bit order of the TC portion of the INTEN source in this mode is reversed in order to avoid any obvious correlation between the INTEN magnitude and the mode's duration, which, as has already been described, is determined by TC.

To further improve the realism of the device in the static mode, INTEN source is processed by probability map 750. The function of probability map 750 is to statistically weight the selected intensities so that higher intensity levels are favored. The probability distribution is shown at FIG. 9. The horizontal axis of this graph corresponds to (6 bit herein) intensity level, and the vertical axis to the probability of this value occurring. As is clearly depicted, the probability of producing any one intensity is skewed heavily toward the larger intensity values. In the absence of any such weighting, the probability distribution would simply be a flat, horizontal line, indicating that all intensities have an equal probability of being selected. A skew input reads the statistically unrelated SKEW value, which is the latched PRN 710 bits 6 through 4. If the most significant bit (SKEW[2]) is set, then the upper three bits of INTEN output are set. If the next lower bit (SKEW[1]) is set, then the upper two bits of INTEN are set, and so on. In addition to improving the quality of the simulation, the described probability distribution function has the effect of producing a higher average level of brightness than would be afforded in its absence. This makes the television simulator more noticeable.

The final MODE value, binary 01, comprises the flick function previously described, and which will now be explained.

Modulo 1024 flick count down-counter 708 cycles continuously, but each time it reaches zero, it is loaded with a value whose MS two bits comprise two bits of PRN_VAL. Since PRN generator 701 is enabled more often than flick count down-counter 708 is re-loaded, flick count down-counter 708's cycle period is continually changing (note that, whereas the maximum load value for down-counter 705 is binary 1_1111, the minimum load value for down-counter 708 is binary 1000_0000). Each time flick count down-counter 708's output CNT_FLICK 734 reaches zero, flick intensity register 707 is enabled, and the six LS bits from PRN generator 701 are latched as FLICK_INTEN 732. Thus, at varying intervals, varying values are latched as flick intensity register 707 output FLICK_INTEN, which comprises the flick input of Multiplexer 709, and comprises the INTEN 736 module output for flick modes.

Therefore, it can be seen that INTEN output consists of three modes in varying occurrences, where each change of mode corresponds to a simulated change of television program scene:

a ramp function, CNT_RAMP 730, emulating either camera fades with linearly decreasing values, or camera swells with linearly increasing values, where the rate of progression and length of fade or swell varies, a flick function, FLICK_INTEN 732, emulating quick changes of camera perspective via varying magnitudes of values, each occurring for varying amounts of time, and a static function, emulating a steady camera scene, where the value is constant for an entire mode period.

Note that the static mode, selected from two of the four inputs of multiplexer 709, is twice as likely to occur as either the ramp or flick modes, reflecting the more likely occurrence of steady camera scenes in television programs.

An important aspect of accurately emulating a television image is the time factors associated with the operation. This will now be described. All counters in Intensity Controller 601 are clocked by 1 kHz clock CLK_1K 617. Since counter 705's load values vary from 0 to 31, it's cycle times will accordingly vary between zero and 32 milliseconds. Further, since each cycle of counter 705 corresponds to one increment or decrement of counter 706, and since counter 706's range is 256 (i.e., hex 0x100), the duration of a ramp cycle will be in the range of 0 to 8.2 seconds. Since CNT_RAMP also determines when MODE is updated in register 703, the duration of each mode period is also in the range of 0 to 8.2 seconds. Since counter 708's load values vary from 128 (hex 0x080 when PRN_VAL[8:7] is 00) to 896 (hex 0x380 when PRN_VAL[8:7] is 11), the duration of a flick period is in the range of 0.128 to 0.896 seconds.

The previous description has been relevant for the Intensity Controller associated with white LEDs. As will be explained, this version serves as the master Intensity Controller, dictating scene changes for the other Intensity Controllers associated with the colored LEDs. As has been seen, the end of each mode, i.e., scene period, occurs when CNT_RAMP reaches its terminal values, and an indication of this event is provided out of the module as signal SCENE_CHANGE_OUT 738, which is only used for the Intensity Controller block associated with white LEDs.

Colored LED Version:

For Intensity Controllers associated with colored LEDs, holding register 703 is not latched by CNT_RAMP reaching a terminal value, but, rather, via the SCENE_CHANGE_IN input signal. This input signal is sourced by the white LED's Intensity Controller's SCENE_CHANGE_OUT signal via the SCENE_CHANGE signal shown previously in FIG. 6. Thus, the master Intensity Controller block associated with the white LEDs provides coordinated scene changes for all LEDs. In this way, predominant changes in overall color are substantially associated with changes in scene, as occurs in typical television programs.

As is well understood in the art, LSFR pseudo-random generators can be started with different seeds—i.e., starting values in the component shift register—and the seeds associated with the pseudo-random generators of each Intensity Controller block, are different. In this way, the sequences of operation of the various Intensity Controller blocks will proceed differently, as is desired to afford the greatest variety of simulated scene complexities. The actual values of the seeds are inconsequential since any difference between the seeds results in substantial differences between the resulting pseudo-random generator values at any time.

Figure 8:
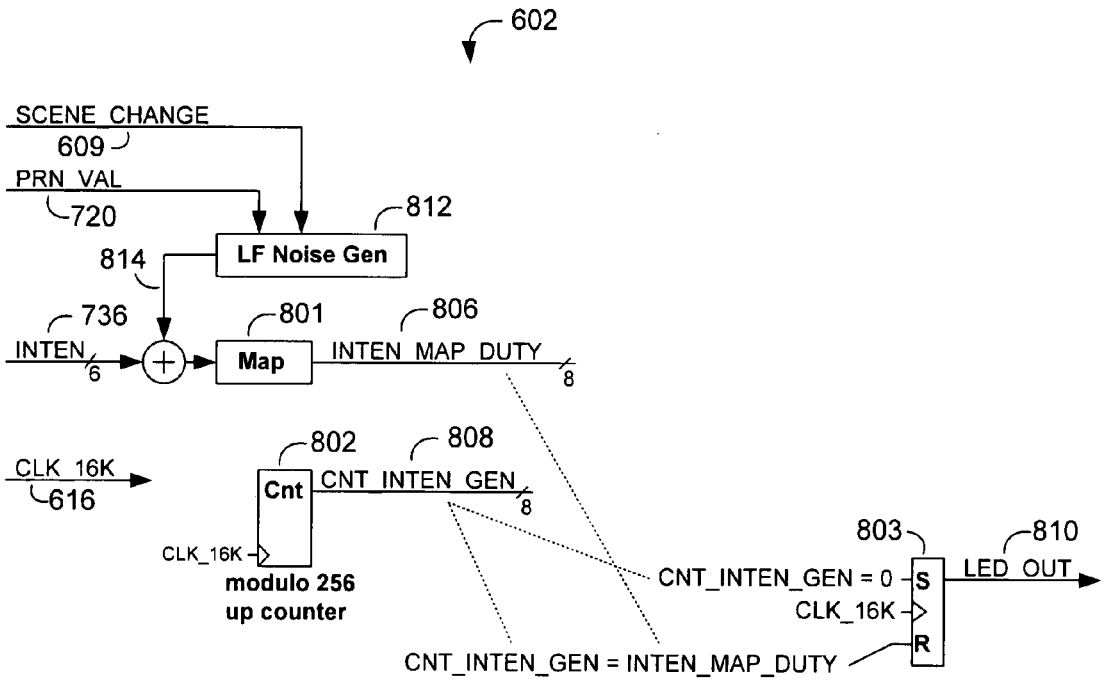
FIG. 8 shows a functional diagram of the Intensity Generator block of FIG. 6.
Figure 10:
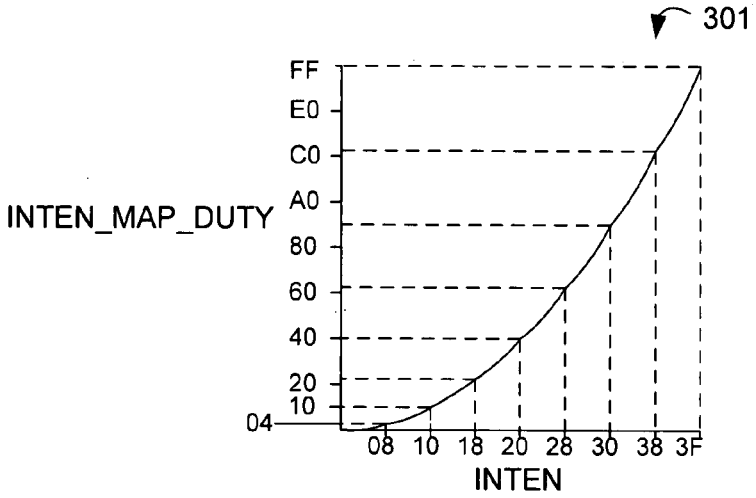
FIG. 10 illustrates a translation graph for the Map function of FIG. 8.
Figure 11:
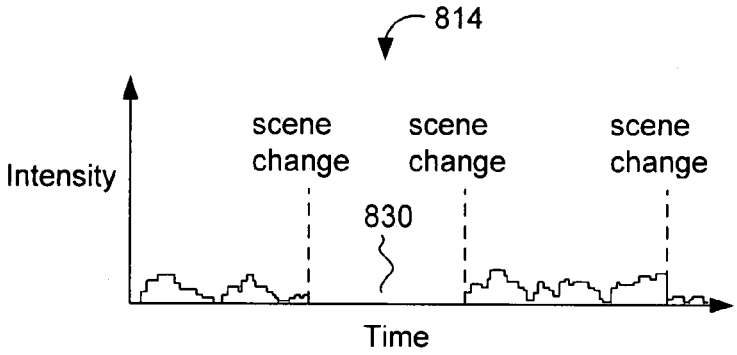
FIG. 11 illustrates an example of the LF noise of FIG. 8.

Intensity Generator with Low Frequency Noise, FIGS. 8, 10, and 11

Whereas the Intensity Controller block just described creates binary word INTEN whose amplitude varies according to simulated television program scene modes, the Intensity Generator block 602 shown in FIG. 6 translates these binary words into a signal appropriate for controlling an LED's intensity.

It is well understood in photometry that perceived brightness is closely proportional to luminance, or emitted power. Further, since the power emitted by the LEDs is closely proportional to the power dissipated by the current passed through it, and since power is related to the square of the current, the perceived brightness of the LEDs is closely proportional to the square of the current passed through the LEDs. I.e., given a certain amount of current, and an associated amount of resulting brightness, a doubling of brightness requires a quadrupling of current.

Thus, a direct translation of INTEN value to LED current would result in perceived brightness that would not seem proportional to the changing values of INTEN. Therefore, as shown in FIG. 8, the preferred embodiment maps INTEN values in Map function 801 into INTEN_MAP_DUTY 806 values via a squaring function, whereby increases in INTEN values result in increases in INTEN_MAP_DUTY that are a square of the amount of INTEN increase. FIG. 10 illustrates the map relationship between INTEN and INTEN_MAP_DUTY performed by Map function 801.

The intensity generator further includes a low frequency (LF) noise generator 812, to realistically simulate the effect of low frequency noise 464 and 470 in the signal, shown previously in FIGS. 2 and 3. LF Noise generator 812 is connected such that it adds a low frequency noise component 814 to the input intensity value before conversion to a duty factor. FIG. 11 shows a typical form of LF noise component signal 814. Noise component signal 814 is of an amplitude that may be zero (as shown at 830) and is selected with each new scene. The noise parameters are derived from PRN 710, which is latched each scene change in a similar fashion to MODE 722, TC 724, etc. In this way, the intensity realistically simulates the subtle low frequency noise that is present in television light output.

One possible mechanism for converting the mapped INTEN_MAP_DUTY binary word into a proportional current for driving the LEDs would be to use a digital-to-analog converter device. However, the preferred embodiment uses a more economical method, whereby, instead of varying the steady amplitude of current driven through the LEDs, a similar result is achieved by pulsing a fixed amplitude of current, and varying the pulse's duty cycle, where the duty cycle is proportional to the digital value of INTEN_MAP_DUTY. Modulo 256 counter 802 continually increments, reaching it's maximum 256 value and returning to zero every 256 clocks. Each time counter 802's output CNT_INTEN_GEN 808 returns to zero, set/reset latch 803 is set, and the LED- _OUT signal 810 is at a one (high) state. As counter 802 then increments again, latch 803 is reset, and LED_OUT signal is at a zero (low) state, when counter 802's value equals INTEN_MAP_DUTY. In this way, output signal LED_OUT comprises repeating periods of high states whose duration is proportional to INTEN_MAP_DUTY. Since CNT_INTEN-_GEN cycles every 256 clocks, and the clock rate of CLK_16K 616 is 16 KHz, the repetition rate of the varying pulses is 62.5 Hz, well above the 30 Hz rate where the human brain begins to perceive a flicker.

Figure 12:
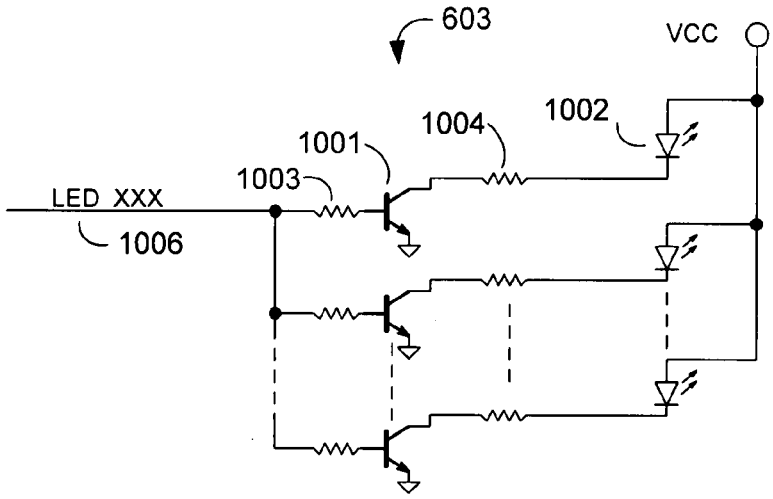
FIG. 12 shows a schematic diagram of the LED block of FIG. 6.

LEDs, FIG. 12

The preferred embodiment implements the previously discussed logic functions in an FPGA device, specifically, a Xilinx Corporation XC3S100E Spartan FPGA. Although it is possible to drive an LED directly from an FPGA device, the preferred embodiment uses external transistors to enable the LED current in order to both provide a more consistent quantity of current during the on state, and also to allow multiple, parallel LEDs to be used. Implementation of these external transistors in the preferred embodiment is shown in FIG. 12. Here, multiple, transistor/LED combinations are shown, and only one pair is described since the rest operate in an identical manner. Transistor 1001 serves as a switch, either turned off, withholding current to its associated LED 1002 so that no light is emitted when control signal LED_XXX 1006 is low, or turned on, allowing current to flow through the LED so that light is emitted when control signal LED_XXX is high. Resistor 1003 limits the current flowing into transistor 1001's base terminal, and is sized so that the transistor is saturated when control signal LED_XXX is high, but not so low in resistance as to cause damage to the transistor. Resistor 1004 limits the current flowing through both LED 1002 and transistor 1001's collector, and is sized such that the LED is adequately activated, but not so low in resistance as to cause damage to either the transistor or the LED. Similar sets of transistor/LED serve each color of the preferred embodiment. For the white color, control signal LED_XXX is connected to signal LED_WHITE 610 shown in FIG. 6, while for the red color, control signal LED_XXX is connected to signal LED_RED 611, for the green color, control signal LED_XXX is connected to signal LED GREEN 612, and for the blue color, control signal LED_XXX is connected to signal LED_BLUE 613. Alternatively, yellow LED's may be used in place of green. Appropriately colored LEDs are used according to the color indicated as connected to control signal LED_XXX.

Figure 13:
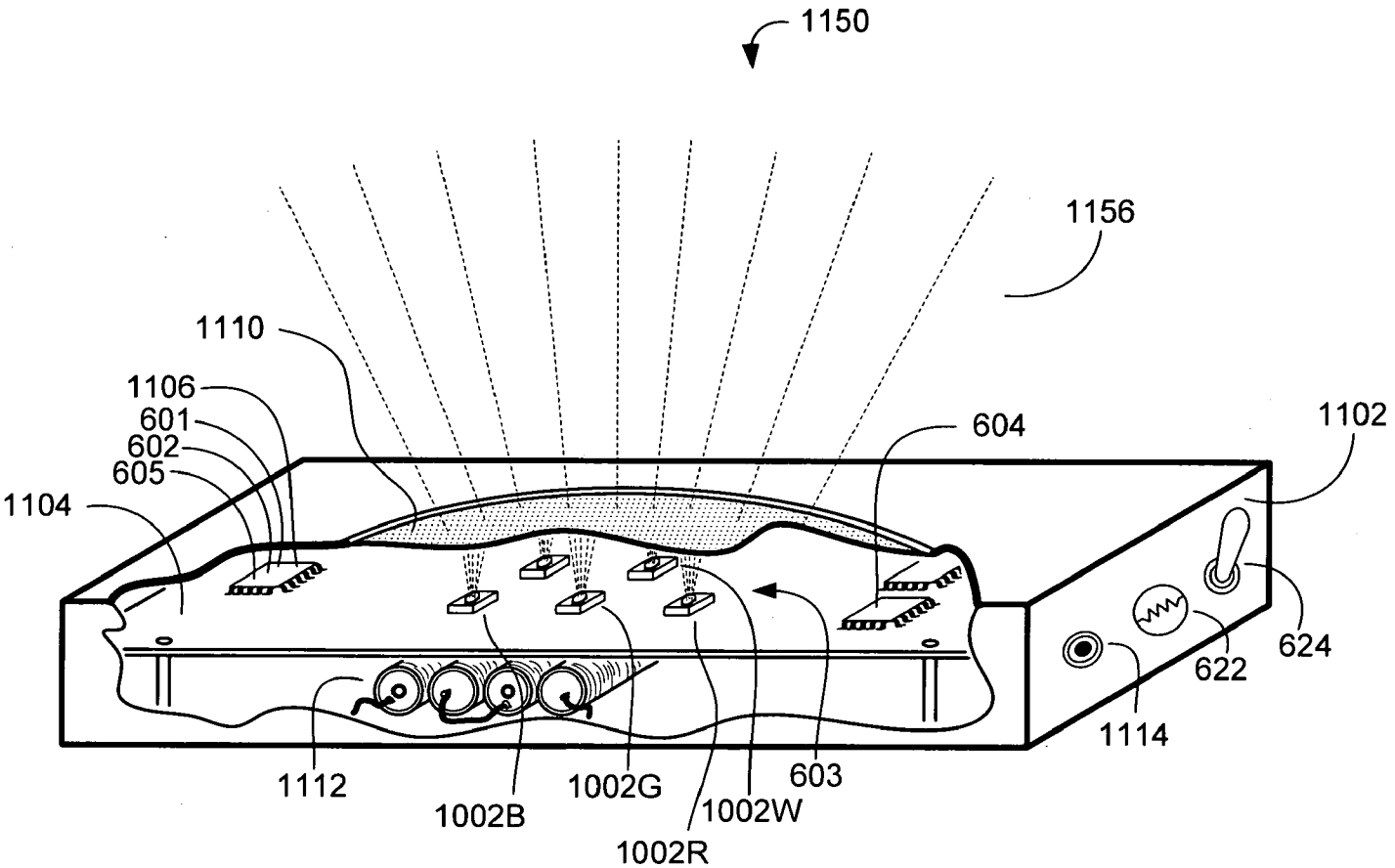
FIG. 13 is an illustration of the preferred embodiment device.
Figure 14:
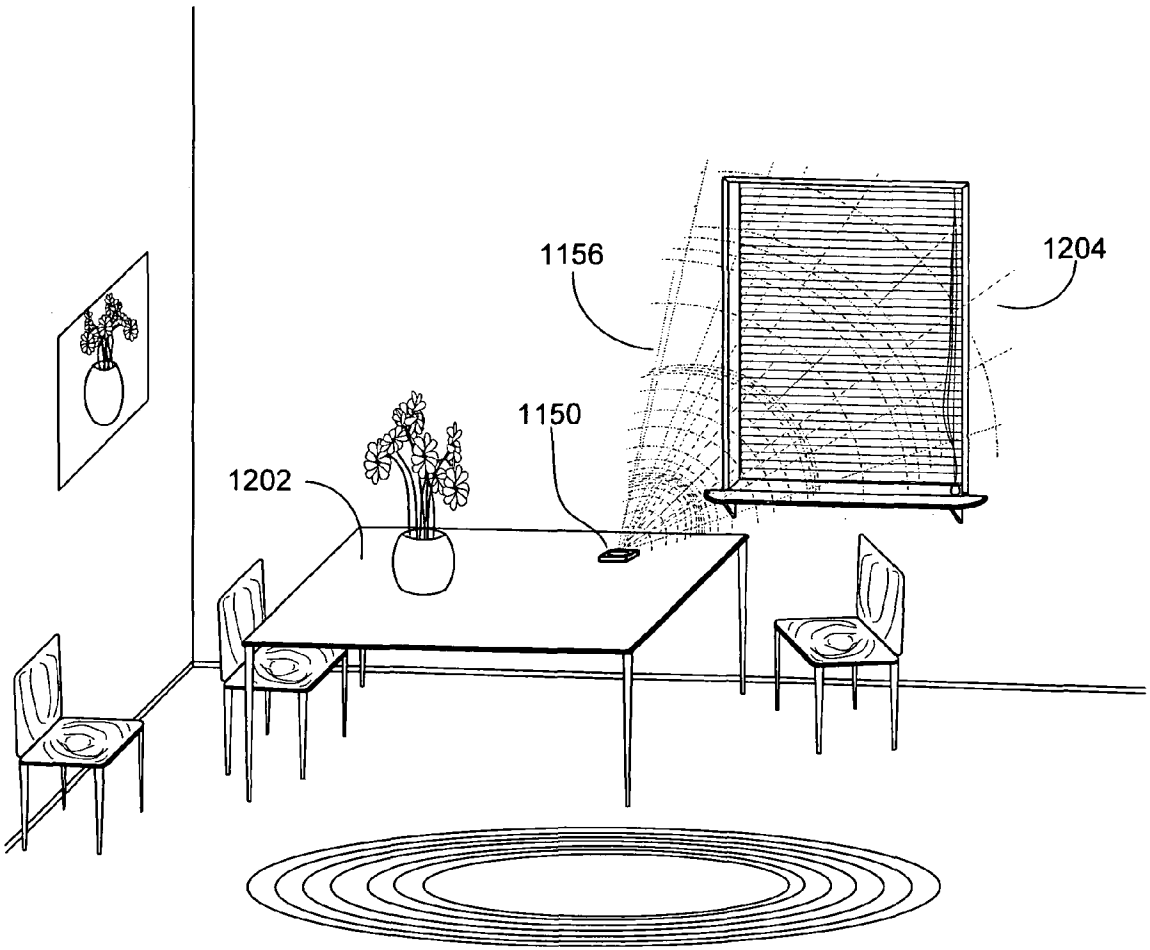
FIG. 14 is an illustration of the preferred embodiment in a typical application.

Form and Application, FIGS. 13, 14

FIG. 13 depicts the form of the preferred embodiment shown generally at 1150. Plastic case 1102 houses circuit board 1104, batteries 1112, and light diffusing screen 1110. Circuit board 1104 comprises the television circuit simulator, and includes clock oscillator component 604, and surface-mount LED circuitry 603, which includes white LED 1002W, red LED 1002R, blue LED 1002B, and green LED 1002G. FPGA 1106 hosts functions 601, 602, and 605, all shown in previous FIG. 6. LED circuitry 603 produces multi-colored, characteristically varying light which is diffused by diffusing screen 1110 to produce a single, melded light source 1156 which mimics the melded image of a real television, and which can be shown on surfaces visible from outdoors.

A separate, commonly available, external DC power supply adapter (not shown) can optionally be used via external powering jack 1114. Light sensing element 622 and switch 624 aid in controlling the simulators operation during post-dusk periods, as described earlier in FIG. 6.

FIG. 14 depicts the preferred embodiment device 1150 as it might be used in a typical application. Here, the device is placed on table 1202, and the diffused LED light 1156 is directed towards the partially closed blinds of outside window 1204. From outside, window 1204 would appear to be illuminated by an operating television inside.

Packaging, Powering, and Operation

The size of the device's enclosure is substantially determined by the quantity of LEDs implemented, since the FPGA component is small compared to the space required for the LEDs and associated transistors. The preferred embodiment, for example, uses five white LEDs, and one each of the other three colors, for a total of eight LEDs, with room for three size AA batteries. A frosted cover diffuses the LED's beamed light somewhat, producing an even mix of colors across an approximate 5-foot radius, e.g., an area sufficient to cover most home windows.

The preferred embodiment is powered either off of the internal batteries 1112 just described, or an external AC wall adapter, such as LTE's GFP101U-0515. Light sensor 622 is deployed on the side of the device, permitting the "dusk plus seven hours" mode of operation described previously.

In operation, the device is placed such that the diffused beam shines on a window's shade, partially closed blinds or other such covering, or an internal wall so as to be illuminated as seen from the outside. As with an actual television in operation, this is predominantly visible after dark.

Note that, as used in the preferred embodiment, the fifteen-bit pseudo-random generator provides over twenty-four hours of operation of the device before the processes repeat. This is, of course, many times longer than any person could reasonably expect to detect.

CONCLUSION, RAMIFICATIONS, AND SCOPE

Accordingly, the reader will see that due to the sophistication of the simulated scene fades, swells, flicks, and static periods, the invention provides a realistic simulation of an operating television. The use of LEDs as a light source provides for a device that is reliable and energy-efficient, and this, in combination with a small size and integrated control circuitry, affords a very economical manufacturing cost. As a consequence of the efficiency of LEDs, the invention can operate from household electricity, or from batteries, and, since there is no programming or setup required, the device is extremely easy to use.

In subjective experiments with a prototype of the invention, acceptable emulation of an operating television required unanticipated changes in the light output. That is, that the light output achieve different, random levels for varying length of time. It is essential that these levels be highly randomized, so that the direction of shifts be unpredictable to the observer. That is, the intensity may begin at a low level, shift to a higher level, and then assume a level higher still. It is important that the level "bounce around," and not simply go from high, to low, and back again. A simple shifting back and forth between a few discreet levels would also be perceived to an observer as having some peculiar unknown origin, but not render the impression of a television set in operation.

In the preferred embodiment of the invention, PRN 201 is used to introduce randomness to the invention. In the context of this invention, "randomness" is best interpreted in terms of human perception. By "at random", it is meant herein that a typical observer would interpret the result as having originated from a random source. As already noted, the fifteen-bit pseudo-random generator of the preferred embodiment provides over twenty-four hours of operation of the device before the processes repeat, and is, of course, many times longer than any person could reasonably expect to detect. A shorter sequence of random numbers, therefore, may be used to generate shorter sequences of varying amplitude light and color before the processes repeat. Even a sequence of thirty seconds of properly programmed television simulation, using the teachings herein, may be perceived to be random by a human observer, although the simulation would not be as high a quality as that described herein. Also, whereas the preferred embodiment uses a logically-derived pseudo-random generator, alternatives such as inherently complex signal sources, e.g., radio noise, or truly random generators could be used for providing the various non-regular sequences and values of the invention's operation.

The preferred implementation of colors is as described: the white, green, red, and blue colored LED's produced an exceptionally realistic simulation. Alternatively, the white LED's may be eliminated, provided that the dynamic range of all three colors is limited about a value, preventing a resulting hue that strays too far from being perceived as white. In a lower cost embodiment, the green LED's may be omitted, as these have the largest spectral overlap with the white. Also, the dynamic range of the preferred embodiment includes the ability to turn the LEDs completely off. Alternatively, the dynamic range of any LED may be restricted (that is, never turning completely off), and the intensities may be taken from a non-uniform probability density distribution.

Although the preferred embodiment describes certain specific methods for producing the characteristically varying emitted light to simulate the melded light of television programs, it will be obvious to one practiced in the art that similar techniques as those described could be applied. For example, although the preferred embodiment uses an FPGA to implement the logic functions that produce static, flick, and ramp effects, it will be understood by one skilled in the art that similar implementations can be achieved using a microprocessor. Any number of algorithms may be substituted to produce the appropriate signals taught herein, without departing from the intention of the invention. The various nomenclatures used in this invention are not intended in any way to limit the scope of the invention. For example, MODE could just as well have been named "SCENE". The important aspect of the simulation-generation algorithm is that it implement the aspects of television simulation that have been taught herein, and any number of approaches may effectively do this.

The resulting simulation is highly effective; when prototypes of the invention were deployed in actual home situations, observer subjects were unable to say whether the resulting light output was from a real television or the simulator.

We claim:

1. An intruder deterrent device that simulates an operating television by projecting light of varying amplitude and hue, said light of varying amplitude and hue emulating the melded image of typical television programs, including, a) a television simulating control circuit, said control circuit including a plurality of outputs, b) said control circuit varying the amplitude of each of said outputs differently, c) a first light source of a first color, operatively coupled to a first output of said control circuit, wherein said first light source varies in amplitude in accordance with said varying amplitude of said first output, d) a second light source of a second color, operatively coupled to a second output of said control circuit, wherein said second light source varies in amplitude in accordance with said varying amplitude of said second output, e) means for projecting and mixing the light output of said first and second light sources, resulting in a perceived intensity and color hue, f) said control circuit varying the amplitude of said outputs such that the perceived intensity operates in accordance with scene-simulating forms, wherein the duration of each said scene-simulating form is selected randomly, said scene-simulating forms being selected randomly from a set including:

i) static scene-simulating forms each having a randomly selected constant perceived intensity, ii) fade scene-simulating forms of decreasing said perceived intensity, said fade scene-simulating forms each having a randomly selected initial perceived intensity and having a randomly selected negative rate of intensity progression, iii) swell scene-simulating forms of increasing said perceived intensity, said swell scene-simulating forms each having a randomly selected initial perceived intensity and having a randomly selected positive rate of intensity progression, g) said scene-simulating forms each also including a randomly selected initial hue, such that changes in said perceived hue are associated with changes in said scene-simulating forms, whereby, when shone upon a surface, said light of varying amplitude and hue realistically simulates said melded image of typical television programs, misleading a potential intruder into thinking that occupants are at home.

2. An intruder deterrent device according to claim 1, wherein the set of scene simulating forms further includes flick scene simulating forms characterized by abrupt changes in perceived intensity and having a duration of less than one second.

3. An intruder deterrent device according to claim 1, wherein said control circuit produces perceived intensities that are further characterized by a probability distribution function, said probability distribution function being weighted to more frequently produce outputs of higher intensities.

4. An intruder deterrent device according to claim 1, wherein said control circuit produces perceived intensities that further include a low frequency noise component.

5. An intruder deterrent device according to claim 4, wherein characteristics of said low frequency noise component change when transitioning from one said scene-simulating form to the next.

6. An intruder deterrent device according to claim 1, wherein amplitudes of said control circuit outputs are mapped in a nonlinear fashion such that functional logic changes in intensity result in said control circuit outputs having similar proportional changes of intensity as perceived by the human eye.

7. An intruder deterrent device according to claim 1, wherein said perceived hue changes progressively during said fade scene-simulating forms.

8. An intruder deterrent device according to claim 1 that further includes a light sensor configured to activate said control circuit upon detecting a low light level.

9. An intruder deterrent device according to claim 1 that further includes a timer that de-activates said control circuit after a configured period of time.

* * * * *